US010894684B2

(12) United States Patent
Okada

(10) Patent No.: US 10,894,684 B2
(45) Date of Patent: Jan. 19, 2021

(54) POST-PROCESSING DEVICE

(71) Applicant: KYOCERA Document Solutions Inc., Osaka (JP)

(72) Inventor: Takehiko Okada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/659,340

(22) Filed: Oct. 21, 2019

(65) Prior Publication Data

US 2020/0122498 A1 Apr. 23, 2020

(30) Foreign Application Priority Data

Oct. 22, 2018 (JP) ..... 2018-198571

(51) Int. Cl.

| | |
|---|---|
| ***B65H 29/24*** | (2006.01) |
| ***B42C 1/12*** | (2006.01) |
| ***B65H 29/52*** | (2006.01) |
| *B65H 29/12* | (2006.01) |

(52) U.S. Cl.

CPC ..... *B65H 29/24* (2013.01); *B42C 1/12* (2013.01); *B65H 29/245* (2013.01); *B65H 29/52* (2013.01); *B65H 29/125* (2013.01); *B65H 2301/42262* (2013.01); *B65H 2301/5305* (2013.01); *B65H 2408/12* (2013.01)

(58) Field of Classification Search

CPC ..... B42C 1/12; B65H 29/24; B65H 29/245; B65H 37/04; B65H 2408/12; B65H 2301/42262; B65H 2301/5305

USPC ..... 270/58.07, 58.08

See application file for complete search history.

(56) References Cited

U.S. PATENT DOCUMENTS

| | | | | |
|---|---|---|---|---|
| 5,460,361 | A * | 10/1995 | Mokler | B65H 29/246 271/183 |
| 6,889,971 | B2 * | 5/2005 | Tamura | B42B 2/00 270/58.08 |
| 7,762,539 | B2 | 7/2010 | Nagata et al. | |
| 8,727,345 | B2 * | 5/2014 | Konno | B65H 29/245 271/211 |

(Continued)

FOREIGN PATENT DOCUMENTS

| | | |
|---|---|---|
| JP | 2003-312920 A | 11/2003 |
| JP | 2006-248684 A | 9/2006 |
| JP | 2014-055069 A | 3/2014 |

*Primary Examiner* — Leslie A Nicholson, III

(74) *Attorney, Agent, or Firm* — Studebaker & Brackett PC

(57) ABSTRACT

A post-processing device includes a discharge port through which a sheet is discharged, an intermediate tray, a discharge tray and an air sending part. The air sending part includes an upper air sending member, an upper switching member, a lower air sending member, a lower switching member and a controller. The upper air sending member generates a downward air flow from above the discharge port. The upper switching member is distributable the air flow generated by the upper air sending member to above the intermediate tray and to above the discharge tray. The lower air sending member generates an upward air flow from below the discharge port. The lower switching member is distributable the air flow generated by the lower air sending member to below the intermediate tray and to above the discharge tray. The controller controls the upper switching member and the lower switching member.

7 Claims, 7 Drawing Sheets

(56) References Cited

U.S. PATENT DOCUMENTS

| | | | | |
|---|---|---|---|---|
| 8,960,668 | B2 * | 2/2015 | Obuchi | G03G 15/6552 271/211 |
| 9,075,377 | B2 * | 7/2015 | Nagasako | B65H 29/14 |
| 9,316,986 | B2 * | 4/2016 | Nagasako | B65H 29/125 |

* cited by examiner

POST-PROCESSING DEVICE

INCORPORATION BY REFERENCE

This application is based on and claims the benefit of priority from Japanese patent application No. 2018-198571 filed on Oct. 22, 2018, which is incorporated by reference in its entirety.

BACKGROUND

The present disclosure relates to a post-processing device performing a post-processing including a stapling processing for stapling a bundle of sheets.

The post-processing device performing a stapling processing is provided with an intermediate tray on which sheets to be stapled are temporarily stacked to form a bundle of the sheets. Because the sheet is conveyed to the post-processing device after heat-fixed, when the bundle contains a large number of the sheets or the stapling processing is continuously performed, a heat of the sheet is stored inside the device and a temperature around the intermediate tray is increased. Then, the sheet is kept at a high temperature, and a problem that the sheets are adhered to each other on the intermediate tray may occur. Especially, the problem may occur in case of a low melting point toner. Furthermore, in case of a duplex printing, because the heat-fixing is performed twice, the temperature increase of the sheet easily occurs, and the sheets are easily adhered to each other by the toner images formed on both faces of the sheet.

Then, the post-processing device is sometimes configured to cool the sheet and the bundle of sheets. For example, the post-processing device is provided with a heat radiation belt which comes into contact with an upper face of a sheet stacked on a processing tray (the intermediate tray) to cool the sheet, a cooling fan which sends an air to a post-processing unit from a direction perpendicular to a sheet conveyance direction, or an air sending means which sends an air to the sheet from between a sheet discharge means and a sheet stacking means.

However, in case of using the heat radiation belt, when a duplex printing is performed at a high printing speed, it is difficult to cool the sheet sufficiently. In case of using the cooling fan, when the cooling fan sends an air to the sheet in the direction perpendicular to the sheet conveyance direction, the sheet may be flapped. Then, the sheet is displaced when stacked, and an alignment performance of the sheets may deteriorate. Additionally, it is difficult to cool an entire portion of the sheet. In a case of the air sending means sending an air to the sheet between the sheet discharge means and the sheet stacking means, a cooling effect is not sufficiently to cool the sheet conveyed to the intermediate tray.

SUMMARY

In accordance with an aspect of the present disclosure, a post-processing device includes a discharge port through which a sheet is discharged, an intermediate tray, a discharge tray and an air sending part. On the intermediate tray, the sheets are stacked to form a bundle of the sheets. The intermediate tray is disposed on an upstream side of the discharge port in a conveyance direction of the sheet and below the discharge port. On the discharge tray, the sheet and the bundle of sheets discharged through the discharge port are stacked. The discharge tray is disposed on a downstream side of the discharge port in the conveyance direction and below the discharge port. The air sending part sends an air to the sheet and the bundle of sheets to cool the sheet and the bundle of sheets. The air sending part includes an upper air sending member, an upper switching member, a lower air sending member, a lower switching member and a controller. The upper air sending member generates a downward air flow from above the discharge port. The upper switching member is distributable the air flow generated by the upper air sending member to above the intermediate tray and to above the discharge tray. The lower air sending member generates an upward air flow from below the discharge port. The lower switching member is distributable the air flow generated by the lower air sending member to below the intermediate tray and to above the discharge tray. The controller controls the upper switching member and the lower switching member.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, a post-processing device according to an embodiment of the present disclosure will be described with reference to the drawings.

Figure 1:
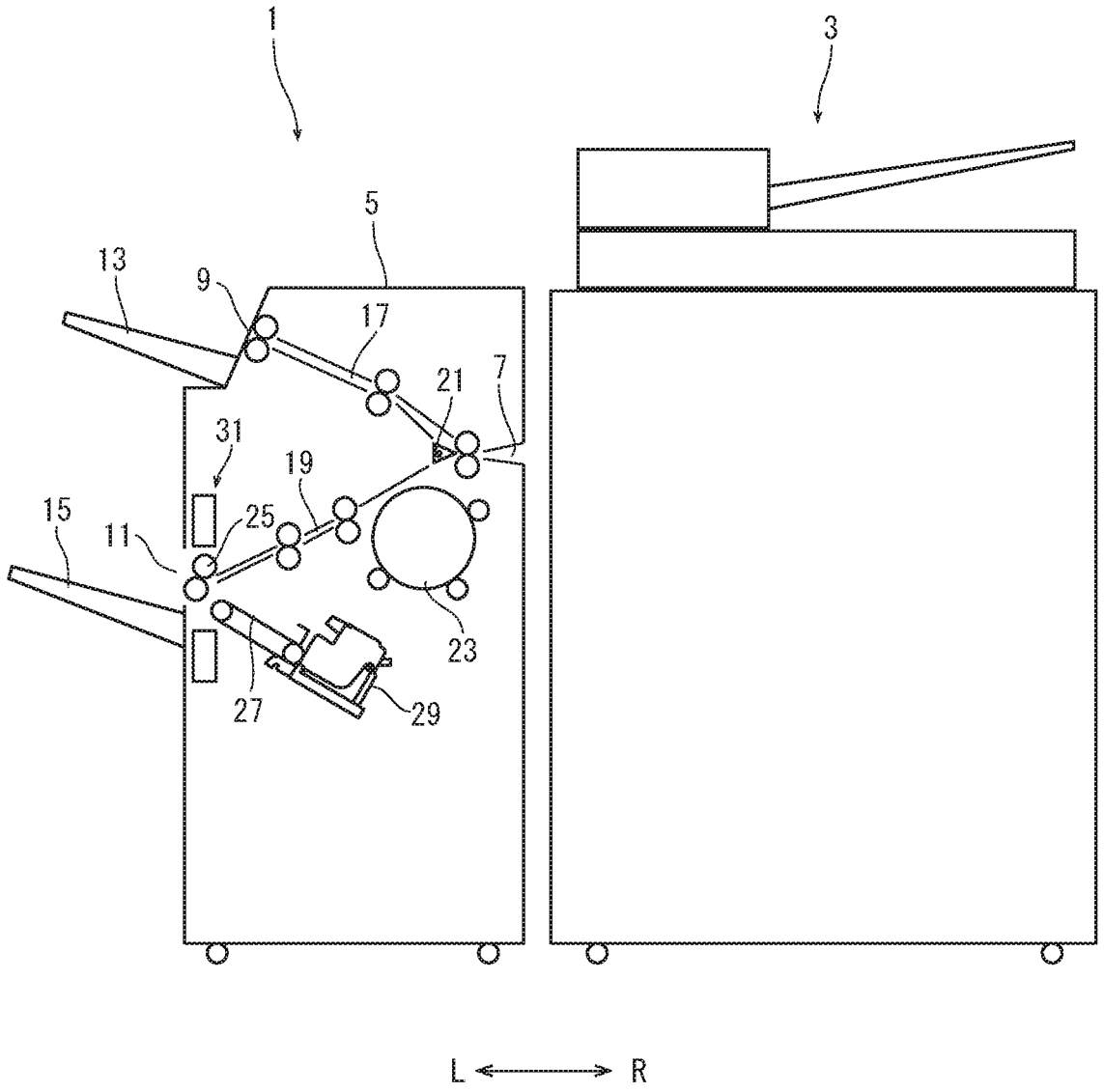
FIG. 1 is a front view schematically showing an inner structure of a post-processing device according to one embodiment of the present disclosure.

Firstly, with reference to FIG. 1, an entire structure of the post-processing device 1 will be described. FIG. 1 is a front view schematically showing an inner structure of the post-processing device 1. A near side (a front side) of a paper surface of FIG. 1 is defined to be a front side of the post-processing device 1. In each figure, Fr, Rr, L and R respectively show a front side, a rear side, a left side and a right side of the post-processing device 1. The post-processing device 1 is disposed adjacent to an image forming apparatus 3 where a toner image is heat-fixed, and performs a post-processing on a bundle of stacked sheets to which the toner image is heat-fixed in the image forming apparatus 3.

The post-processing device 1 includes an approximately parallelepiped main body part 5. The main body part 5 is formed with a receiving port 7 on one side face (a right face) on a side of the image forming apparatus 3. Through the receiving port 7, the sheet to which the image is formed is received from the image forming apparatus 3. The main body part 5 is formed with upper and lower discharge ports 9 and 11 on the other side face (a left face) on an opposite side to the image forming apparatus 3. Below the upper discharge port 9, an auxiliary tray 13 is provided, and below the lower discharge port 11, a discharge tray 15 is provided. As described above, the auxiliary tray 13 and the discharge tray 15 are respectively provided on a downstream side of the upper and lower discharge ports 9 and 11 in a sheet discharge direction.

In the main body part 5, an auxiliary conveyance path 17 and a main conveyance path 19 are formed, which are branched at a branch point disposed inside the receiving port 7. The auxiliary conveyance path 17 extends from the branch point to the upper discharge port 9. The main conveyance path 19 extends from the branch point to the lower discharge port 11. At the branch point, a switching guide 21 is provided so as to selectively guide the sheet received through the receiving port 7 to the auxiliary conveyance path 17 and to the main conveyance path 19.

At the most upstream portion of the main conveyance path 19, a buffer roller 23 is provided, and at the most downstream portion of the main conveyance path 19, a discharge rollers pair 25 is provided. During a period where a staple processing is performed by a stapler 29 described later, if a next sheet is conveyed to the main conveyance path 19, the next sheet is conveyed around the buffer roller 23 to be temporarily stored, and then fed to the main conveyance path 19 at a suitable timing. The discharge rollers pair 25 rotates in a normal direction and in a reverse direction while holding the sheet. When the discharge rollers pair 25 rotates in the normal direction, the sheet conveyed along the main conveyance path 19 is discharged through the lower discharge port 11. When the discharge rollers pair 25 rotates in the reverse direction, the sheet is switched back through the lower discharge port 11. The upper roller of the discharge rollers pair 25 is supported in a movable manner in the upper-and-lower direction.

The main body part 5 is provided with an intermediate tray 27 and the stapler 29 which are disposed below the main conveyance path 19. The intermediate tray 27 is supported so as to incline downwardly from the lower discharge port 11. Then, the intermediate tray 27 is disposed on an upstream side of the lower discharge port 11 in the sheet discharge direction. The intermediate tray 27 includes a plurality of endless belts disposed at intervals in a width direction perpendicular to the sheet discharge direction. On the intermediate tray 27, the sheet switched back through the lower discharge port 11 is stacked, and a bundle of a predetermined number of the sheets is formed. The stapler 29 is disposed below the intermediate tray 27, and performs a stapling processing in which the bundle of sheets on the intermediate tray 27 is stapled (the bundle of sheets is bound using a staple). At the lower discharge port 11, an air sending part 31 which sends an air to the sheet or the bundle of sheets to cool it is provided.

Next, the stapling processing performed by the post-processing device 1 will be described. The sheet to which the image is formed in the image forming apparatus 3 is received through the receiving port 7, and then guided to the main conveyance path 19 by the switching guide 21. The sheet conveyed along the main conveyance path 19 is switched back through the lower discharge port 11 by the discharge rollers pair 25, conveyed to the intermediate tray 27 and then stacked on the intermediate tray 27. After a predetermined number of the sheets are stacked on the intermediate tray 27 and a bundle of the sheets is formed, the stapler 29 staples the bundle of sheets. The stapled bundle of sheets is discharged through the lower discharge port 11 by a discharge mechanism (not shown) provided in the intermediate tray 27 and then stacked on the discharge tray 15. When the bundle of sheets is discharged, the upper roller of the discharge rollers pair 25 moves upward.

Figure 2:
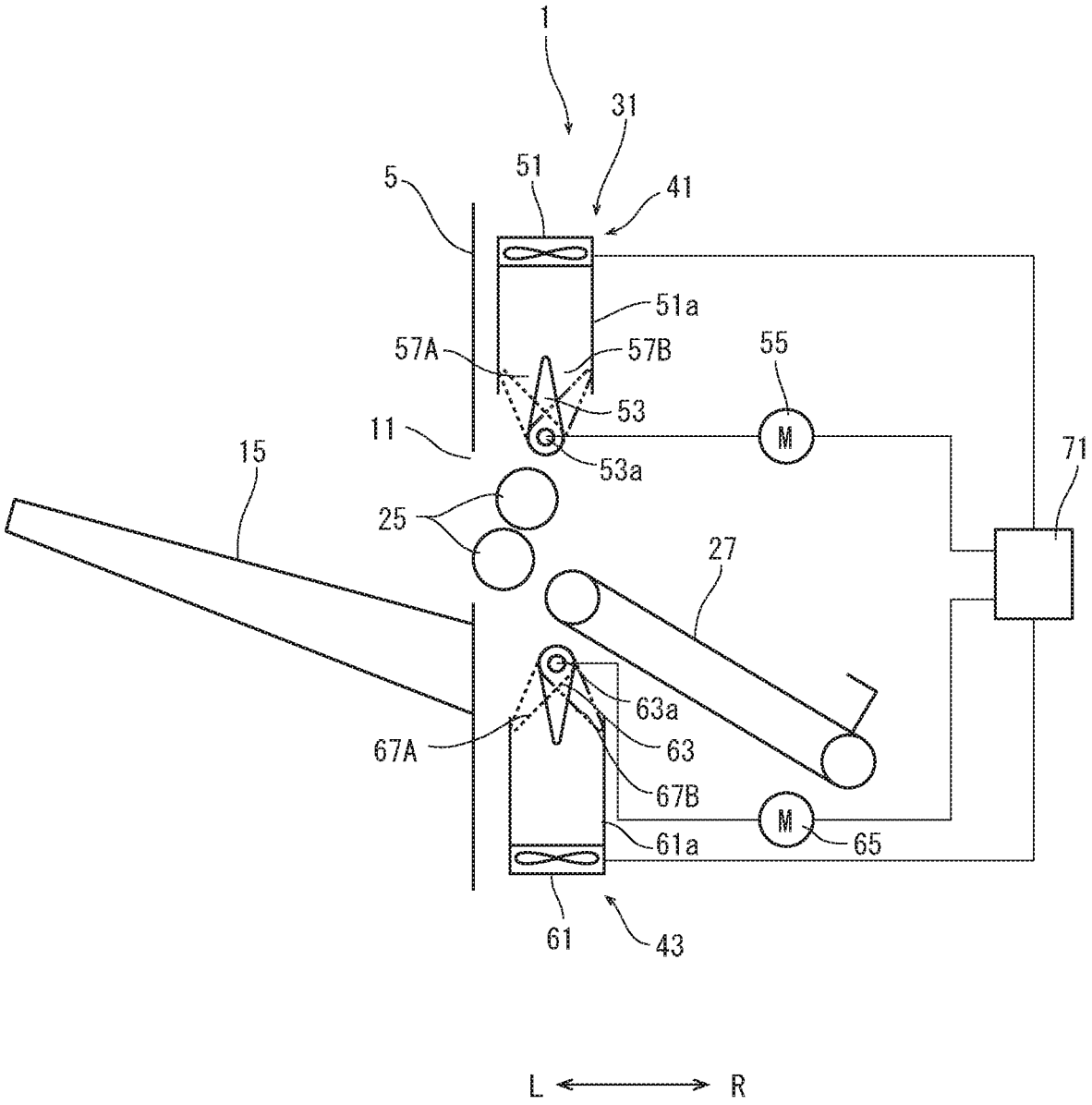
FIG. 2 is a front view schematically showing an air sending part of the post-processing device according to the embodiment of the present disclosure.

Next, with reference to FIG. 2, the air sending part 31 will be described. FIG. 2 is a front view schematically showing the air sending part.

The air sending part 31 includes an upper air sending part 41 disposed above the lower discharge port 11 and a lower air sending part 43 disposed below the lower discharge port 11.

The upper air sending part 41 includes a plurality of (for example, four) upper fans 51 as an upper air sending member and an upper switching fin 53 as an upper switching member. The upper fan 51 is a center fan, for example, and rotates around a rotational shaft. The upper fan 51 has a duct 51*a* extending along the rotational shaft. The upper fans 51 are disposed above the lower discharge port 11 at intervals in the width direction with air sending ports of their ducts 51*a* downward. The upper fans 51 are electrically connected to a controller 71. The controller 71 controls the starting and the stopping of the rotating of the upper fans 51.

The upper switching fin 53 is a member having a cross section of approximately an isosceles triangle, and has a tapered tip end portion. The upper switching fin 53 has a rotational shaft 53*a* along the width direction at an opposite end portion to the tip end portion. The upper switching fin 53 is disposed below each upper fan 51, and the tip end portion enters the duct 51*a* upwardly through a center portion of the air sending port from the lower side. The upper switching fin 53 is supported so as to be turnable around the rotational shaft 53*a*. The rotational shaft 53*a* is connected to a motor 55. The motor 55 is electrically connected to the controller 71. The motor 55 rotates the rotational shaft 53*a* according to a rotational direction and a rotational angle set by the controller 71 to change the posture of the upper switching fin 53.

As shown by a solid line in FIG. 2, when the upper switching fin 53 is turned to an upright posture where the upper switching fin 53 stands approximately uprightly, an outer air path 57A is formed between the outer side wall of the duct 51*a* (the wall on a side of the lower discharge port 11) and the upper switching fin 53 and an inner air path 57B is formed between the inner side wall of the duct 51*a* (the wall on an opposite side to the lower discharge port 11) and the upper switching fin 53. The outer air path 57A is formed along an oblique downward direction toward the outside of the main body part 5, and the inner air path 57B is formed along an oblique downward direction toward the inside of the main body part 5. An air flow generated by the upper fans 51 is distributed by almost equal quantities to the outer air path 57A and to the inner air path 57B by the upper switching fin 53. The air flow distributed to the outer air path 57A is sent to above the discharge tray 15 through between the upper edge of the lower discharge port 11 and the discharge rollers pair 25. In a case where the rollers of the discharge rollers pair 25 each has a rotational shaft and a plurality of roller bodies disposed at intervals in the axial direction of the rotational shaft, the air flow distributed to the outer air path 57A is passed through spaces between the adjacently disposed roller bodies. The air flow distributed to the inner air path 57B is sent to above the intermediate tray 27.

As shown by a chain line in FIG. 2, when the upper switching fin 53 is turned to an outwardly inclined posture where the tip end portion of the upper switching fin 53 is close to the outer side wall of the duct 51*a*, the inner air path 57B is formed between the inner wall of the duct 51*a* and the upper switching fin 53. The inner air path 57B is formed along the oblique downward direction toward the inside of the main body part 5. Almost all quantity of the air flow generated by the upper fans 51 is distributed to the inner air path 57B and sent to above the intermediate tray 27.

On the other hand, as shown by a two-dotted chain line in FIG. 2, when the upper switching fin 53 is turned to an inwardly inclined posture where the tip end portion of the upper switching fin 53 is close to the inner side wall of the duct 51*a*, the outer air path 57A is formed between the outer side wall of the duct 51*a* and the upper switching fin 53. The outer air path 57A is formed along the oblique downward direction toward the outside of the main body part 5. Almost all quantity of the air flow generated by the upper fans 51 is distributed to the outer air path 57A and sent to above the discharge tray 15 through between the upper edge of the lower discharge port 11 and the discharge rollers pair 25.

The lower air sending part 43 includes a plurality of (for example, four) lower fans 61 as a lower air sending member and a lower switching fin 63 as a lower switching member. The lower fan 61 is a center fan, for example, and rotates around a rotational shaft. The lower fan 61 has a duct 61*a* extending along the rotational shaft. The lower fans 61 are disposed below the lower discharge port 11 at intervals in the width direction with air sending ports of their ducts 61*a* upward. The lower fans 61 are electrically connected to the controller 71. The controller 71 controls the starting and the stopping of the rotating of the lower fans 61.

The lower switching fin 63 is a member having a cross section of approximately an isosceles triangle, and has a tapered tip end portion. The lower switching fin 63 has a rotational shaft 63*a* along the width direction at an opposite end portion to the tip end portion. The lower switching fin 63 is disposed above each lower fan 61, and the tip end portion enters the duct 61*a* downwardly through a center portion of the air sending port from the upper side. The lower switching fin 63 is supported so as to be turnable around the rotational shaft 63*a*. The rotational shaft 63*a* is connected to a motor 65. The motor 65 is electrically connected to the controller 71. The motor 65 rotates the rotational shaft 63*a* according to a rotational direction and a rotational angle set by the controller 71 to change the posture of the lower switching fin 63.

As shown by a solid line in FIG. 2, when the lower switching fin 63 is turned to an upright posture where the lower switching fin 63 suspends approximately uprightly, an outer air path 67A is formed between the outer side wall of the duct 61*a* (the wall on the side of the lower discharge port 11) and the lower switching fin 63 and an inner air path 67B is formed between the inner side wall of the duct 61*a* (the wall on an opposite side to the lower discharge port 11) and the lower switching fin 63. The outer air path 67A is formed along an oblique upward direction toward the outside of the main body part 5, and the inner air path 67B is formed along an oblique upward direction toward the inside of the main body part 5. An air flow generated by the lower fans 61 is distributed by almost equal quantities to the outer air path 67A and to the inner air path 67B by the lower switching fin 63. The air flow distributed to the outer air path 67A is sent to above the discharge tray 15 through between the lower edge of the lower discharge port 11 and the discharge rollers pair 25. In the case where the rollers of the discharge rollers pair 25 each has the rotational shaft and the plurality of roller bodies disposed at intervals in the axial direction of the rotational shaft, the air flow distributed to the outer air path 67A is passed through spaces between the adjacently disposed roller bodies. The air flow distributed to the inner path 67B is sent to below the intermediate tray 27.

Because the intermediate tray 27 includes the plurality of endless belts disposed at intervals in the width direction as described above, when the air is sent to below the intermediate tray 27, the air is passed through the spaces between the adjacently disposed endless belts and blown against a lower face of the sheet stacked on the intermediate tray 27. In a case where the intermediate tray 27 has no space described above, because the air is blown against the lower face of the intermediate tray 27, the temperature increase of the intermediate tray 27 is suppressed to some extent so that an effect for cooling the sheet and the bundle of sheets stacked on the intermediate tray 27 is obtained.

As shown by a chain line in FIG. 2, when the lower switching fin 63 is turned to an outwardly inclined posture where the tip end portion of the lower switching fin 63 is close to the outer side wall of the duct 51*a*, the inner air path 67B is formed between the inner wall of the duct 61*a* and the lower switching fin 63. The inner air path 67B is formed along the oblique upward direction toward the inside of the main body part 5. Almost all quantity of the air flow generated by the lower fans 61 is distributed to the inner air path 67A and sent to below the intermediate tray 27.

On the other hand, as shown by a two-dotted chain line in FIG. 2, when the lower switching fin 63 is turned to an inwardly inclined posture where the tip end portion of the lower switching fin 63 is close to the inner side wall of the duct 61*a*, the outer air path 67A is formed between the outer side wall of the duct 61*a* and the lower switching fin 63. The outer air path 67A is formed along the oblique upward direction toward the outside of the main body part 5. Almost all quantity of the air flow generated by the lower fans 61 is distributed to the outer air path 67B and sent to above the discharge tray 15 through between the lower edge of the lower discharge port 11 and the discharge rollers pair 25.

Figure 4:
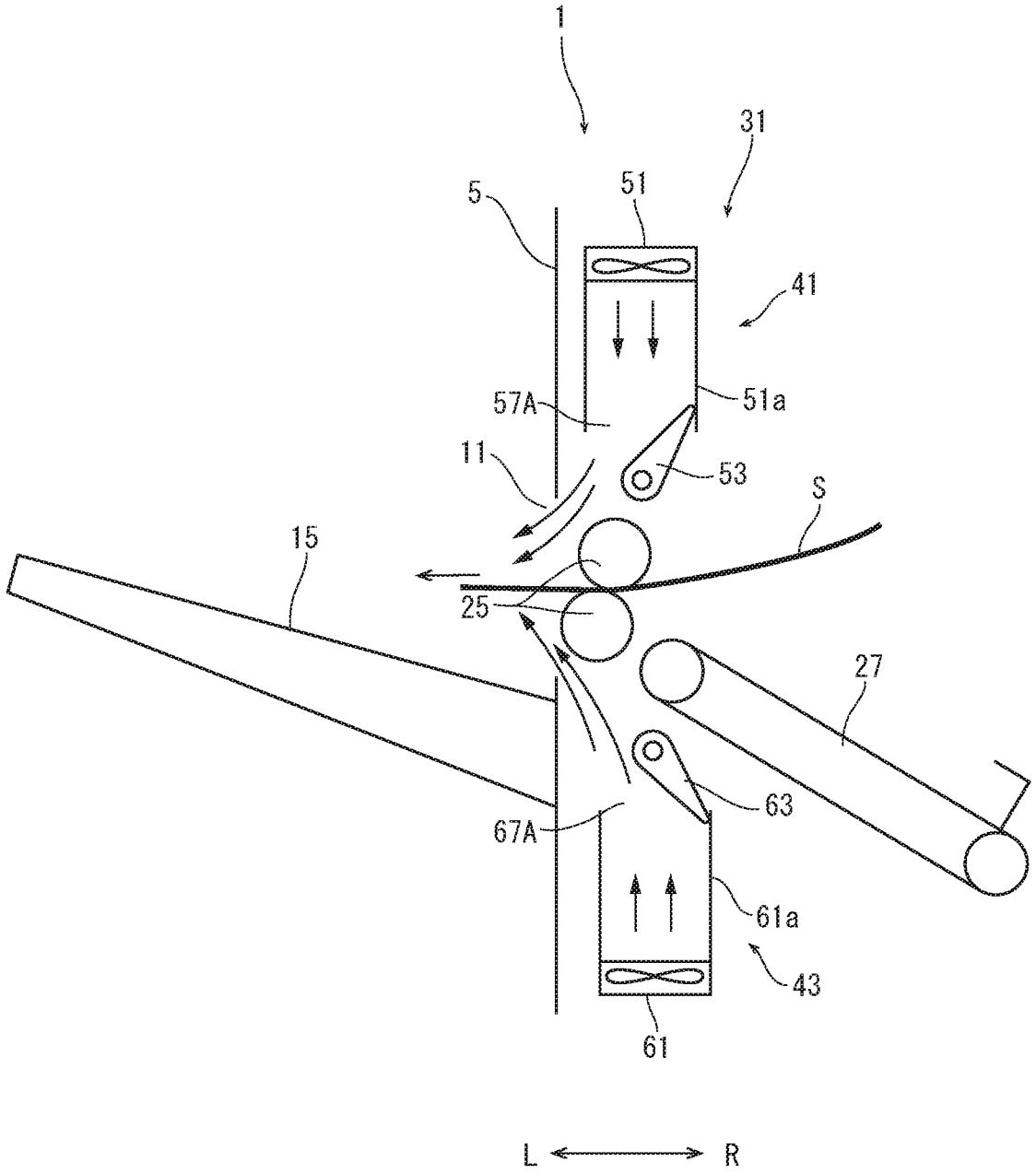
FIG. 4 is a front view schematically showing the air sending part when a sheet is discharged, in the post-processing device according to the embodiment of the present disclosure.
Figure 5:
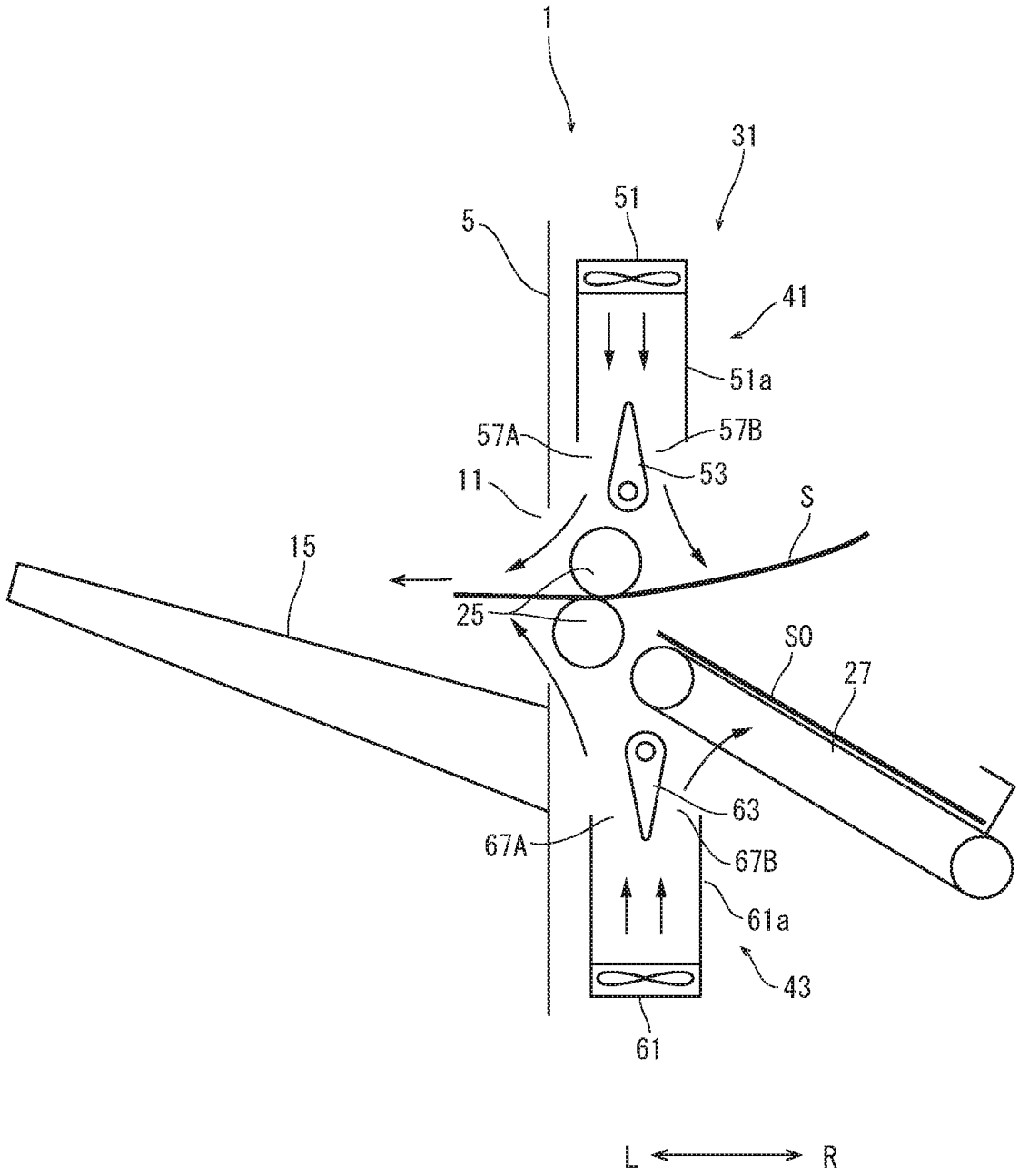
FIG. 5 is a front view schematically showing the air sending part when a bundle of sheets is formed, in the post-processing device according to the embodiment of the present disclosure.
Figure 6:
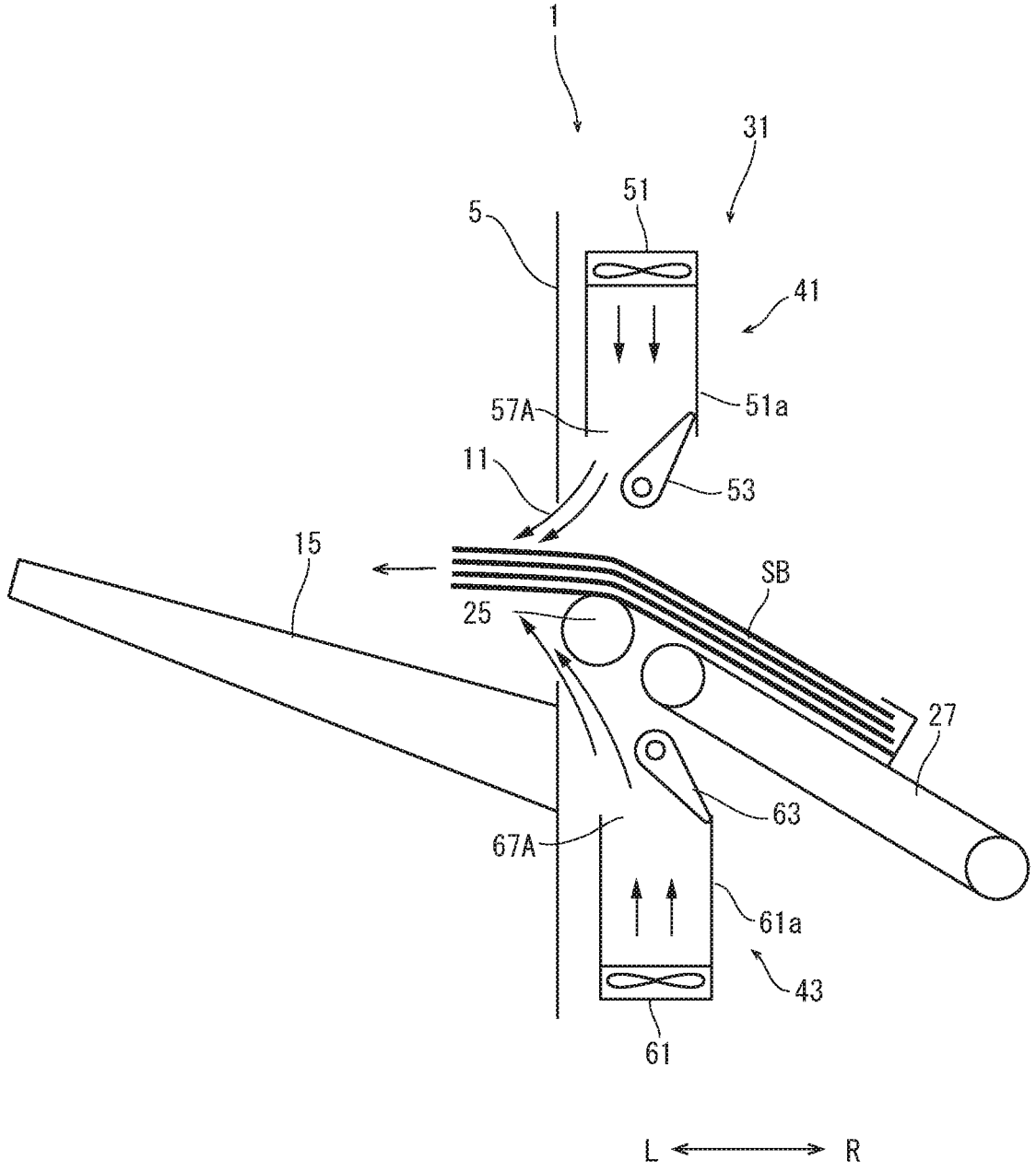
FIG. 6 is a front view schematically showing the air sending part when the bundle of sheets is discharged, in the post-processing device according to the embodiment of the present disclosure.

An example of an air sending operation of the air sending part 31 having the above described configuration will be described with reference to a flowchart shown in FIG. 3, and FIG. 4 to FIG. 6. FIG. 4 to FIG. 6 are front views schematically showing the air sending part 31.

Firstly, at step S1, it is determined whether a bundle of sheets is formed on the intermediate tray 27, in other words, whether the stapling processing is performed. When it is determined that the bundle of sheets is not formed on the intermediate tray 27 at step S1, it proceeds to step S2.

At step S2, the controller 71 controls the motor 55 of the upper air sending part 41 to turn the upper switching fin 53 in the inwardly inclined posture, and controls the motor 65 of the lower air sending part 43 to turn the lower switching fin 63 in the inwardly inclined posture. Then, the outer air paths 57A and 67A are respectively formed in the upper and lower air sending parts 41 and 43, and it proceeds to step S3. At step S3, the controller 71 starts the rotating of the upper and lower fans 51 and 61 of the upper and lower air sending parts 41 and 43. Additionally, the sheet conveying is started. The sheet is conveyed along the main conveyance path 19

(refer to FIG. 1), discharged through the lower discharge port 11 by the discharge rollers pair 25 and then stacked on the discharge tray 15.

As shown in FIG. 4, when the sheet S is being discharged through the lower discharge port 11, the air is blown against an upper face and a lower face of the sheet S through the outer air paths 57A and 67A of the upper and lower air sending parts 41 and 43, and the sheet S is cooled. In detail, almost all quantity of the air flow generated by the upper fans 51 is distributed to the outer air path 57A, and blown against the upper face of the sheet S discharged above the discharge tray 15. Almost all quantity of the air flow generated by the lower fans 61 is distributed to the outer air path 67A, and blown against the lower face of the sheet S discharged above the discharge tray 15. As a result, the sheet S being discharged is cooled from both the upper and lower sides.

Next, at step S4, it is determined whether all of the predetermined number of sheets are discharged on the discharge tray 15. At step S4, when it is determined that all of the sheets are discharged, it proceeds to step S5. At step S5, the controller 71 stops the rotating of the upper and lower fans 51 and 61 of the upper and lower air sending parts 41 and 43.

At step S1, when it is determined that the bundle of sheets is formed on the intermediate tray 27, in the other words, the stapling processing is performed, it proceeds to step S6.

At step S6, the controller 71 controls the motor 55 of the upper air sending part 41 to turn the upper switching fin 53 to the upright posture, and controls the motor 65 of the lower air sending part 43 to turn the lower switching fin 63 to the upright posture. Then, the outer air path 57A and the inner air path 57B, and the outer air path 67A and the inner air paths 67B are respectively formed in the upper air sending part 41 and the lower air sending part 43. After that, it proceeds to step S7. At step S7, the controller 71 starts the rotating of the upper and lower fans 51 and 61 of the upper and lower air sending parts 41 and 43. At the same time, the conveying of the sheet S is started. The sheet S is conveyed along the main conveyance path 19, switched back through the lower discharge port 11 by the discharge rollers pair 25 and then stacked on the intermediate tray 27.

As shown in FIG. 5, when the sheet S is being discharged through the lower discharge port 11 by the discharge rollers pair 25 once, almost half quantity of the air flow generated by the upper fans 51 and almost half quantity of the air from generated by the lower fans 61 are distributed to the outer air path 57A and the outer air path 67A, and blown against the upper face and the lower face of the sheet S protruding above the discharge tray 15, respectively. Additionally, almost half quantity of the air flow generated by the upper fans 51 is distributed to the inner path 57B and blown against the upper face of the sheet S inside the lower discharge port 11. Almost half quantity of the air flow generated by the lower fans 61 is distributed to the inner path 67B and blown against the lower face of the sheet S which has been switched back and stacked on the intermediate tray 27. As described above, the sheet S which is being switched back through the lower discharge port 11 and the sheet 50 which has been staked on the intermediate tray 27 after switched back are cooled.

Then, the predetermined number of sheets is stacked on the intermediate tray 27, a bundle of the sheets is formed on the intermediate tray 27 and then the stapling processing is performed on the bundle of sheets. After that, at step S8, it is determined whether the discharge mechanism of the intermediate tray 27 starts the discharge operation to discharge the bundle of sheets from the intermediate tray 27 to the discharge tray 15. At step S8, when it is determined that the discharge mechanism starts the discharge operation, it proceeds to step S9.

At step S9, the controller 71 controls the motor 55 of the upper air sending part 41 to turn the upper switching fin 53 from the upright posture to the inwardly inclined posture, and controls the motor 65 of the lower air sending part 43 to turn the lower switching fin 63 from the upright posture to the inwardly inclined posture. Thereby, the outer air paths 57A and 67A are respectively formed in the upper and lower air sending parts 41 and 43. Then, as shown in FIG. 6, almost all quantity of the air flow generated by the upper fan 51 is distributed to the outer air path 57A and then blown against the upper face of the bundle SB of sheets being discharged by the discharge mechanism, and almost all quantity of the air flow generated by the lower fan 61 is distributed to the outer air path 67A and then blown against the lower face of the bundle SB of sheets being discharged by the discharge mechanism. Then, the air flow is blown against the upper face and the lower face of the bundle SB of sheets being discharged by the discharge mechanism to cool the bundle SB of sheets.

Then, it proceeds to step S10. At step S10, it is determined whether a next bundle of sheets is formed on the intermediate tray 27. At step S10, when it is determined that the next bundle of sheets is formed on the intermediate tray 27, it returns to step S6. On the other hand, when it is determined that the next bundle of sheets is not formed, it proceeds to step S5. Then, at step S5, the controller 71 stops the rotating of the upper and lower fans 51 and 61 of the upper and lower air sending parts 41 and 43.

As understood from the above description, according to the post-processing device 1 of the present disclosure, when the sheet is discharged or switched back and when the bundle of sheets is discharged, the air flow is blown against the upper face and the lower face of the sheet and the bundle of sheets. Accordingly, it becomes possible to cool the sheet and the bundle of sheets which has been heated by the heat-fixing and to prevent the adhesion of the sheets. Additionally, the air flow is blown against the sheet from the upper side and the lower side so that it becomes possible to reduce the flapping of the sheet. As described above, even in the cases of a high-speed printing and a duplex printing, the adhesion of the sheets and the flapping of the sheet are reduced so that it becomes possible to stack the sheets stably and to form the bundle of aligned sheets.

Figure 3:
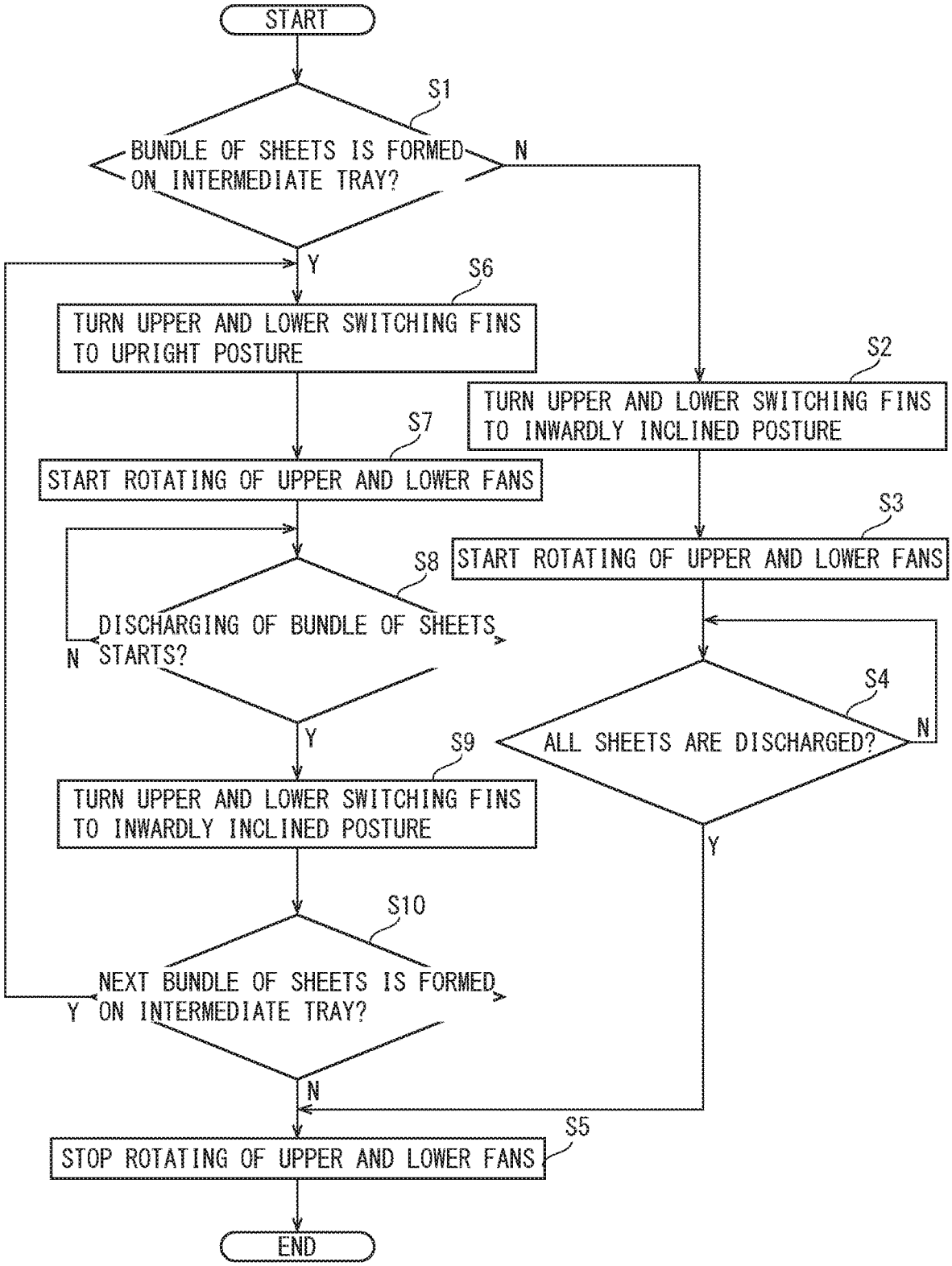
FIG. 3 is a flowchart showing an air sending operation of the air sending part, in the post-processing device according to the embodiment of the present disclosure.

In the air sending operation referred to the flowchart shown in FIG. 3, because the upper and lower switching fins 53 and 63 are turned to the upright posture at step S6, the air quantity of the air flow distributed to the outer air paths 57A and 67A toward the discharge tray 15 is almost the same as the air quantity of the air flow distributed to the inner air paths 57B and 67B toward the intermediate tray 27. However, in this case, it is preferable to make the air quantity of the air flow distributed to the inner air paths 57B and 67B larger than the air quantity of the air flow distributed to the outer air paths 57A and 67A. The intermediate tray 27 is disposed in the inside of the main body part 5 where is under a higher humid environment than the outside because the heat of the conveyed sheet is easily stored. Thereby, the air quantity of the air flow distributed to the inner air paths 57B and 67B toward the intermediate tray 27 disposed in the inside of the main body part 5 is made to be larger than the air quantity of the air flow distributed to the outer air paths 57A and 67A toward the discharge tray 15 disposed in the outside of the main body part 5 so that it becomes possible to inhibit the temperature increase inside the main body part 5.

When the sheet is stacked on the discharge tray 15 (a case where N is selected at step S1 of the flowchart shown in FIG. 3), the upper and lower switching fins 53 and 63 are turned in the inwardly inclined posture, and the air is sent above the discharge tray 15. In this case, before the tip edge of the sheet is separated from the discharge rollers pair 25 until the rear edge of the sheet is separated from the discharge rollers pair 25, it is preferable to send the air above the discharge tray 15, in other words, to turn the upper and lower switching fins 53 and 63 to the inwardly inclined posture.

Then, because the air is sent to the sheet which is held by the discharge rollers pair 25, it becomes possible to prevent the flapping of the sheet and to stack the sheet on the discharge tray 15 with a high alignment.

The present embodiment shows a case where the upper and lower switching fins 53 and 63 are turned to the upright posture, the outwardly inclined posture and the inwardly inclined posture. However, the turned posture of the upper and lower switching fins 53 and 63 is not limited to the above postures. Depending on the conveyance speed of the sheet and the printing condition (a one-side printing or a both-side printing, for example), the turning angles of the upper and lower switching fins 53 and 63 may be changed to adjust the distribute ratio of the air quantity of the outer air paths 57A and 67A to the air quantity of the inner air paths 57B and 67B. Alternatively, the air quantity of the upper and lower fans 51 and 61 may be the same or may be different from each other. Alternatively, the air quantity of the upper and lower fans 51 and 61 may be adjusted depending on the condition.

Figure 7:
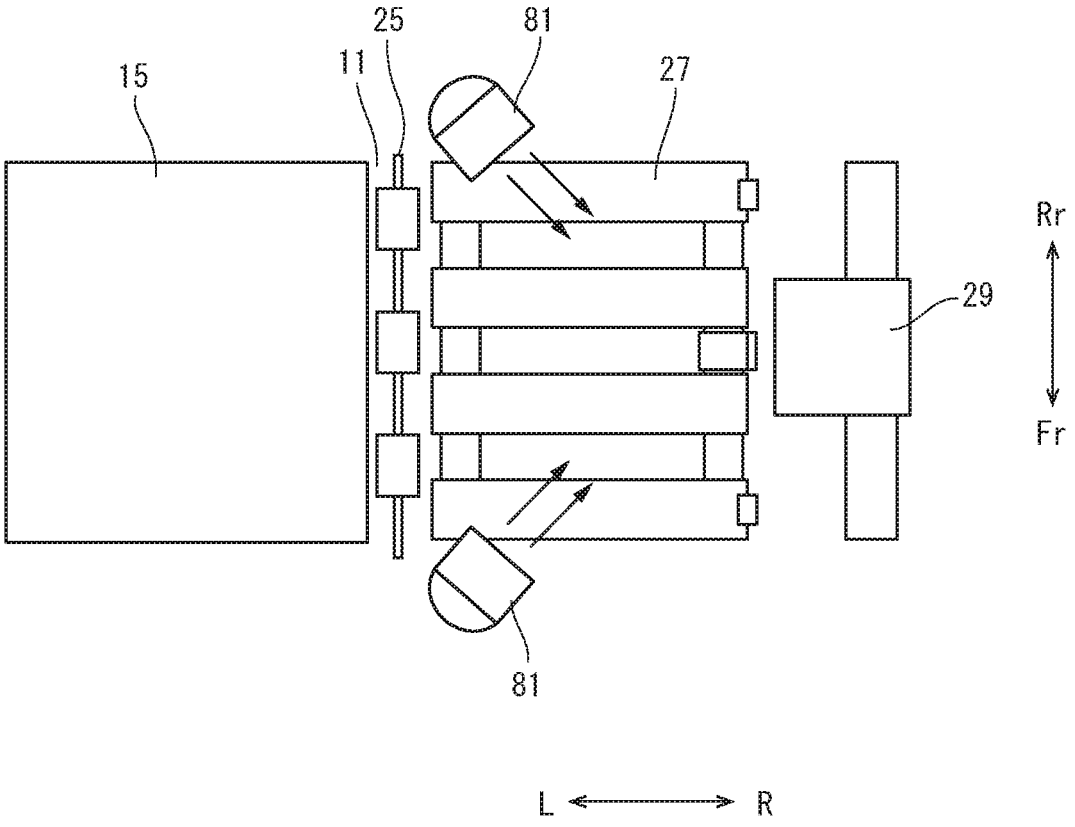
FIG. 7 is a plan view schematically showing another example of the air sending part, in the post-processing device according to the embodiment of the present disclosure.

Next, with reference to FIG. 7, another embodiment of the air sending part 31 will be described. FIG. 7 is a view schematically showing the air sending part when viewed from the upper side.

In the embodiment, the air sending part 31 includes two auxiliary air sending units 81 in addition to the upper and lower air sending parts 41 and 43. The auxiliary air sending unit 81 is a sirocco fan, for example. The auxiliary air sending units 81 are disposed on the front side and the rear side of the intermediate tray 27, and send an air flow above the intermediate tray 27 from the oblique rear sides with respect to the switching back direction of the sheet (the conveyance direction to the intermediate tray 27). The air quantity of the auxiliary air sending units 81 is smaller than that of the upper and lower fans 51 and 61.

The auxiliary air sending unit 81 sends an air to the upper face of the sheet which is being switched back to the intermediate tray 27 to cool the sheet. Accordingly, it becomes possible to heighten the cooling effect and to inhibit the temperature increase of the inside of the main body part 5. Additionally, because the air is sent from the oblique rear directions to the switching back direction of the sheet, it becomes possible to prevent the flapping of the sheet and to increase the alignment performance of the sheets.

The post-processing device 1 of the present embodiment may be applied to the post-processing device for an inkjet type image forming apparatus. In this case, the ink which is not dried sufficiently may be dried to prevent the adhesion of the sheets and the contamination of the sheet with the ink.

Although the present disclosure described the specific embodiment, the present disclosure is not limited to the embodiment. It is to be noted that one skilled in the art can modify the embodiment without departing from the scope and spirit of the present disclosure.

The invention claimed is:

1. A post-processing device comprising:

a discharge port through which a sheet is discharged;

an intermediate tray on which the sheets are stacked to form a bundle of the sheets, the intermediate tray disposed on an upstream side of the discharge port in a conveyance direction of the sheet and below the discharge port;

a discharge tray on which the sheet and the bundle of sheets discharged through the discharge port are stacked, the discharge tray disposed on a downstream side of the discharge port in the conveyance direction and below the discharge port; and an air sending part which sends an air to the sheet and the bundle of sheets to cool the sheet and the bundle of sheets, wherein the air sending part includes:

an upper air sending member which generates a downward air flow from above the discharge port;

an upper switching member distributable the air flow generated by the upper air sending member to above the intermediate tray and to above the discharge tray;

a lower air sending member which generates an upward air flow from below the discharge port;

a lower switching member distributable the air flow generated by the lower air sending member to below the intermediate tray and to above the discharge tray; and a controller which controls the upper switching member and the lower switching member.

2. The post-processing device according to claim 1, wherein when the sheet or the bundle of sheets is discharged through the discharge port, the controller controls the upper switching member to distribute almost all of the air flow generated by the upper air sending member to above the discharge tray, and controls the lower switching member to distribute almost all of the air flow generated by the lower air sending member to above the discharge tray, and when the sheet is switched back through the discharge port and then stacked on the intermediate tray to form the bundle of sheets, the controller controls the upper switching member to distribute the air flow generated by the upper air sending member to above the discharge tray and to above the intermediate tray, and controls the lower switching member to distribute the air flow generated by the lower air sending member to above the discharge tray and to below the intermediate tray.

3. The post-processing device according to claim 1, wherein when the bundle of sheets is formed on the intermediate tray, the controller controls the upper switching member to make a quantity of the air flow distributed to above the intermediate tray larger than a quantity of the air flow distributed to above the discharge tray, and controls the lower switching member to make a quantity of the air flow distributed to below the intermediate tray larger than a quantity of the air flow distributed to above the discharge tray.

4. The post-processing device according to claim 1, wherein the intermediate tray includes a plurality of endless belts disposed at intervals in a width direction perpendicular to the conveyance direction.

5. The post-processing device according to claim 1, comprising a discharge rollers pair which holds the sheet and rotates to discharge the sheet through the discharge port, wherein each of the discharge rollers includes a rotational shaft and a plurality of roller bodies disposed at intervals in an axial direction of the rotational shaft, and the air flow generated by the upper air sending member and the lower air sending member is distributed to above the discharge tray through a space between the adjacently disposed roller bodies.

6. The post-processing device according to claim 1, comprising a discharge rollers pair which holds the sheet and rotate to discharge the sheet through the discharge port, wherein when the sheet is discharged to the discharge tray, the controller controls the upper switching member and the lower switching member to distribute the air flow generated by the upper air sending member and the lower air sending member to above the discharge tray only during a period where the discharge rollers pair holds the sheet.

7. The post-processing device according to claim 1, wherein the air sending part includes auxiliary air sending units which are disposed on both sides of the intermediate tray in a width direction perpendicular to the conveying direction and generates an air flow toward above the intermediate tray from an oblique rear direction with respect to a conveyance direction of the sheet to the intermediate tray.

* * * * *